United States Patent [19]

Salete

[11] 3,960,068

[45] June 1, 1976

[54] MACHINE FOR WHITENING, POLISHING OR PEARLING GRAINS AND CEREALS AND MORE PARTICULARLY RICE

[76] Inventor: Felipe Salete, Av. Ano de Juarez No. 198, Granjas San Antonio, Ixtapalapa, Mexico City 13, Mexico

[22] Filed: Jan. 29, 1975

[21] Appl. No.: 545,315

[52] U.S. Cl. ..... 99/606; 99/607; 99/610

[51] Int. Cl.[2] ..... B02B 3/06

[58] Field of Search ..... 99/603, 604, 605, 606, 99/607, 610, 611, 617; 241/86.1, 88.2, 93; 51/4, 22, 72 R

[56] References Cited

UNITED STATES PATENTS

| | | | |
|---|---|---|---|
| 1,020,377 | 3/1912 | Walker | 99/606 |
| 1,389,277 | 8/1921 | Smith | 99/617 X |
| 2,618,307 | 11/1952 | Keller | 99/606 |

*Primary Examiner*—Leonard D. Christian
*Assistant Examiner*—Alan Cantor
*Attorney, Agent, or Firm*—Haseltine, Lake & Waters

[57] ABSTRACT

A whitening, polishing or pearling machine for grains and cereals and more particularly for rice, vertically disposed, composed of an integral chamber which has an entry or grain feeder, said grain being transported to a section where it is treated in order to whiten or polish it, the grain once treated being passed through a centrifugal extractor to collect the product, or to a regulating hopper which is connected directly to another machine exactly like the first in order to complete the treatment or to another process if the grain has now been totally polished.

The grain is treated by centrifuging by means of a rotor which casts it toward screens, raising it by the thrust of a feed screw which rubs the grains against each other, against the screens and also against work-intensifying knives located within the treatment section or chamber, driving out the particles of the flour produced during treatment to a discharge where they are collected.

The system of operation uses a blower which produces air under pressure which serves the function of cooling the grain which is heated by friction and at the same time drives the flour through the said screen.

The outstanding characteristics of the machine are those related to its vertical disposition and to the fact that in a single unit are included the moving system of whitening, transmissions, motors and the ventilation system.

The vertical disposition of the machine affords the advantage of eliminating elevators or stepped installations since the machine itself elevates the product during the process.

8 Claims, 5 Drawing Figures

MACHINE FOR WHITENING, POLISHING OR PEARLING GRAINS AND CEREALS AND MORE PARTICULARLY RICE

BACKGROUND OF THE INVENTION

In rice mills it is necessary to work in a manner avoiding so far as possible breaking the grain, particularly in the stages of husking and polishing or whitening. The polishing or whitening machines now known have certain drawbacks, since for example the emery cone or cylinder machines are very bulky and heavy and require very solid bases which involve special installation and high cost.

The machines for horizontal operation use grain elevators which also complicate and increase the cost of installation of such machines. To avoid the use of grain elevators for feeding and discharge, the machines are installed at successive levels and for the work of inspection stairways are used, which requires greater space for the installation as well as slow and complicated operation. In the compact horizontal machines the polishing or whitening of the grain is harsh and irregular because rotation of the rotor causes intermittent projection of the grains, which are accelerated or decelerated depending on the cycle of elevation or drop.

A further drawback is that existing machines use screens having hexagonal section and file-like teeth set in the edges of the perforations in an irregular manner so that many grains are subject to violent treatment and others to more moderate attack, because they are driven down many times against a screen or shell which is hexagonal or octagonal causing breakage in a high percentage specially of the weaker grains. Breakage of weak grains makes the treatment uneconomic; hence it is necessary to provide a machine which eliminates all the said drawbacks.

The whitening and polishing or pearling machine for grains and cereals and more particularly for rice of the present invention has none of the drawbacks mentioned, since the whitening or polishing of the grain is uniform and every grain is subjected to the same treatment in a smooth and continuous manner. The grains are elevated simultaneously within a vertical drum screen which has an ample separation between the rotor and the screen, so that the grains are subject to the same friction and the product is of uniform quality. Rubbing between one grain and the next is more intense while contact with hard parts such as rotor and screen is moderate, with the advantage that the intensity of the action can be graduated by means of certain knives whose approach can be regulated breaking up the continuity of spinning of the grains, scraping them and holding them and allowing them more or less time according to the whitening or polishing desired.

OBJECTS OF THE INVENTION

It is an object of the invention to provide a whitening, polishing or pearling machine for grains and cereals and more particularly for rice which permits of connecting several machines on a single level in order to carry out various steps of whitening or polishing of the grain.

It is another object to provide a machine for whitening or polishing rice which operates continuously and silently and which produces a whitened product of uniform quality with the least breakage of grains. Hence several different types of grains can be processed, weak or strong, always obtaining a product of outstanding quality.

A further object of the invention is to provide a whitening, polishing or pearling machine for grains and cereals and more particularly for rice which basically has the rotor vertically disposed to provide a soft and uniform pressure without excessive impact, avoiding breakage of the grains.

Still another object of the invention involves a machine the treatment chamber of which consists of an enveloping screen through which the grains are passed upward from below driven by a screwfeed and a rotor whereby the grains are made to rub one another and to also rub against the screens and against certain knives or rasps, the flour dust so produced passing out through the screens to a lower outlet where it is collected.

One additional object of the invention is to provide a whitening, polishing or pearling machine for grains and cereals and more particularly for rice which can operate independently or alternatively can be connected to one or more additional machines on the same floor level either directly or by means of regulating intermediate hoppers always on the same level.

DESCRIPTION OF THE DRAWINGS

The machine of the present invention will be described in connection with the accompanying drawings of which:

FIG. 3 shows a plan view of the uncovered machine, in which intensifying knives 17 can be seen and device 18 for regulating their movement. By means of the movement of the knives and depending on the distance of the rotor therefrom two effects are produced, one of which is the rasping or friction of the grains and the other is retention of said grains to vary and regulate the intensity of the process, depending on whether they approach or withdraw from said rotor. Clearly seen in this drawing are rotor 19 and cylindrical drum screen 20, hereafter simply called screen; on the left is shown the inlet for grain 15.

Figure 1:
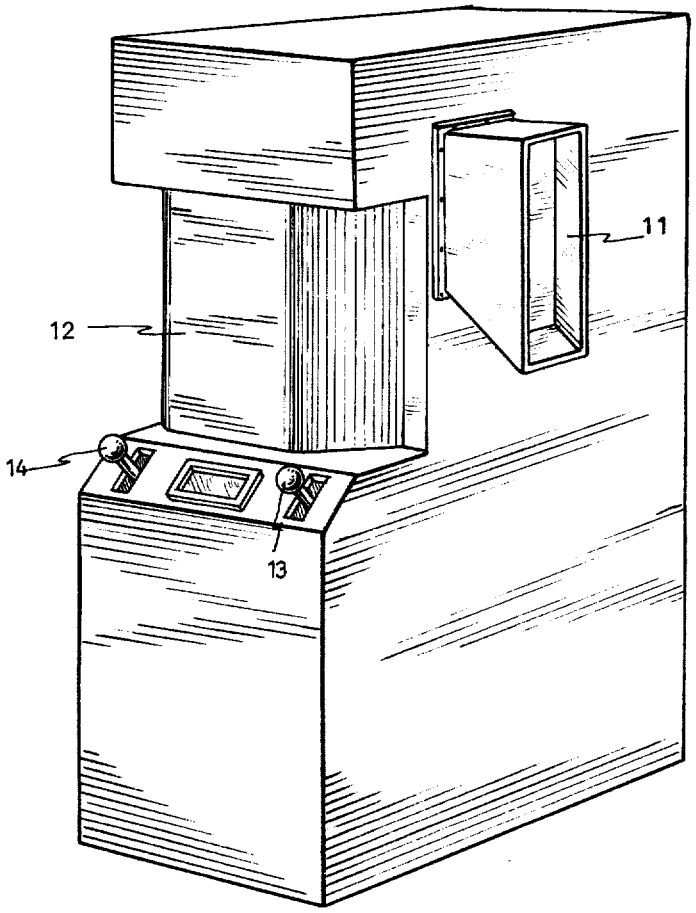
FIG. 1 shows a perspective view of the machine in which can be seen the discharge 11 of the treated grain, the observation window 12, and the control levers 13 and 14, which move the knives and the air inlet respectively.
Figure 2:
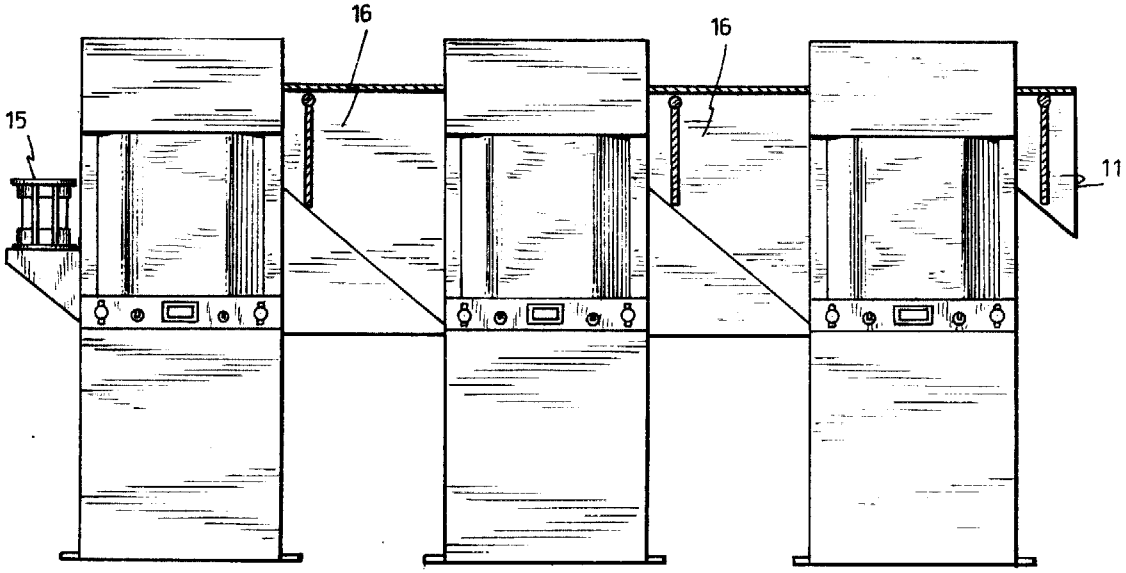
FIG. 2 shows a series of three machines connected together on a single level, in which appears inlet 15 for the grain to be treated and hoppers 16 for connecting the machines together, the flow of grain coming out of one machine and passing to the next being regulated by said hoppers. Outlet 11 also appears in this figure, where the grain which has been treated in the three machines shown is collected.
Figure 2:
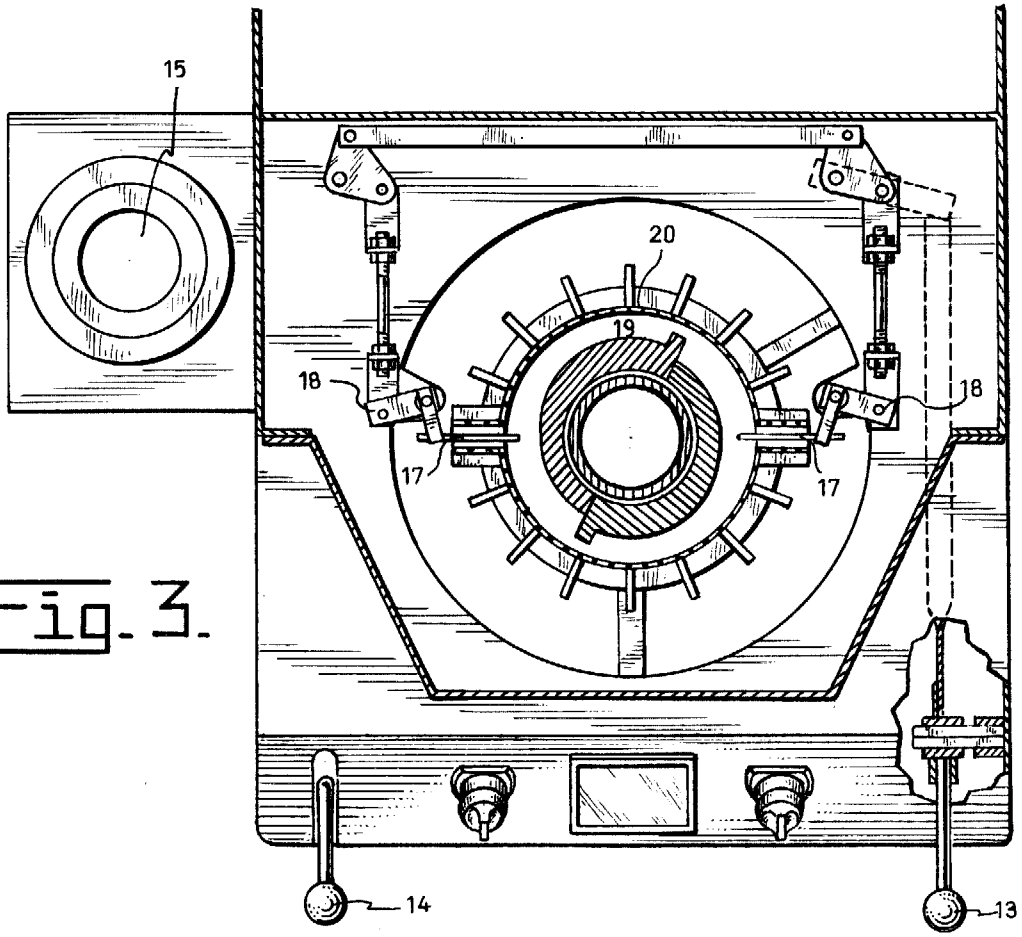
Figure 4:
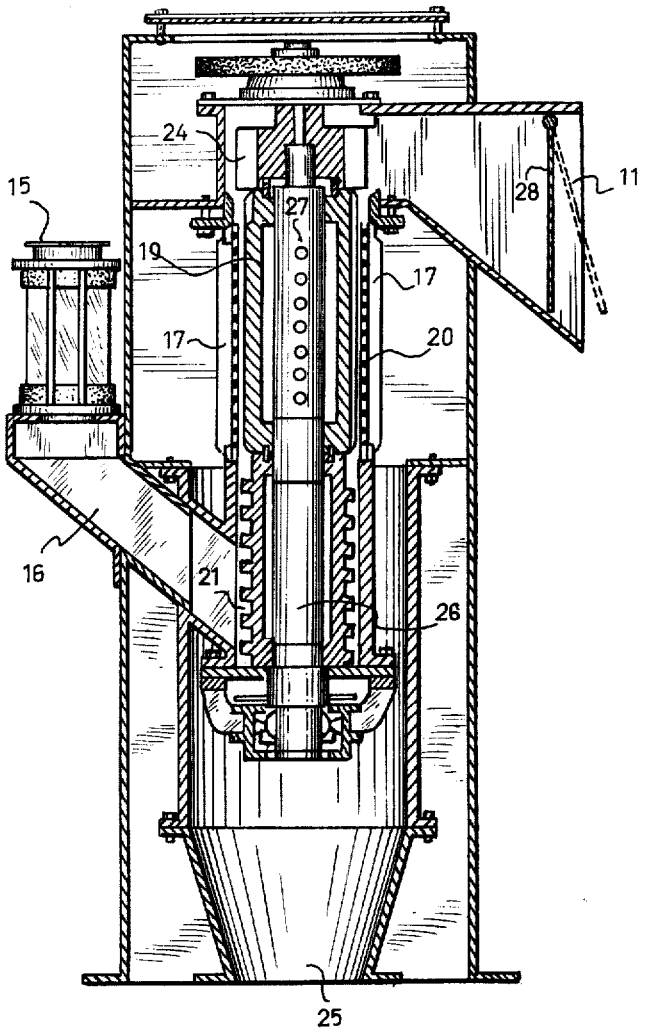
FIG. 4 is a cross-section of the machine of the present invention, also showing inlet 15 of the grain to be processed, which is coveyed through passage 16, dropping by gravity to the bottom of the screwfeed impeller 21, which elevates the grains past impeller rotor 19, which spins the grains with greater speed producing a rubbing effect among them and projecting them against screen 20, the movement of the grains being interrrupted as above noted by knives 17, which in this drawing appear in their long dimension. The grains are elevated in the cylindrical drum and projected till they reach extractor 24, which ejects the grains by outlet 11, either to another similar machine or another process as desired.

The flour dust which is taken off the product passes through screen 20 above mentioned and falls by gravity through outlet 25. It must be understood that the air movement produced by the blower enters hollow shaft 26 and ascends therethrough and finds an outlet in holes 27 in the shaft of rotor 19, so that the air passes through screen 20, colling the grains being polished and also moving the flour dust through screen 20 as above mentioned. Deflecting plate 28 forms part of outlet 11 and is used to regulate the discharge of the grain.

Figure 5:
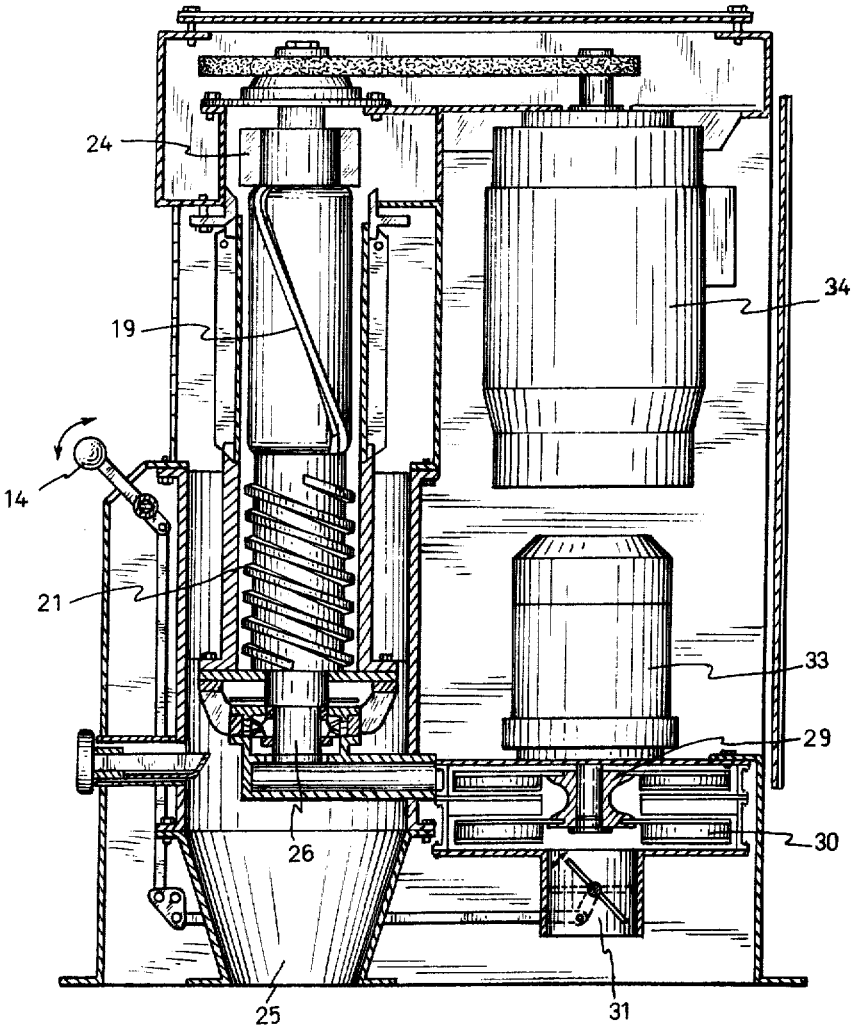

FIG. 5 is a longitudinal section of the machine of the present invention, shown practically in its entirely; on the left is control lever 14, with which the mechanism is regulated to allow a greater or less airflow coming from blower 29 which has rotary blades 30.

By movement of valve 31 airflow to the treatment chamber is regulated as above noted. Screwfeed impeller 21 can be seen which carries the grain to the upper part of the chamber as well as rotor 19 which moves the grain toward extractor 24 which as noted expels the grain to the outlet. Blower 29 is driven by motor 33 and is of two-stage design, discharging the air into tube 26 and the air volume being regulated by valve 31.

As is understood from the description and drawings, the operation of the machine is continuous and virtually silent and affords efficiency never before known in horizontal operation machines. The product is normally processed in three stages, in practice; but it is possible if desired to reduce the number of stages, and operation can be conducted in a single stage at reduced capacity, retaining the product for a longer time in the work chamber by means of deflecting plate 28.

Thus far the invention has been described in relation to its preferred embodiments, it being clear that changes made therein based on the invention thus described and hereinafter claimed fall within the scope of same.

I claim:

1. A whitening, polishing or pearling machine for grains and cereals and more particularly for rice, vertically disposed and within which are integrated the mobile system for polishing, transmissions, motors and ventilation system, comprising an integral chamber with a lateral inlet for the grain, which is continued into a conduit which empties into the bottom of a substantially cylindrical treatment chamber composed of a hollow shaft which at its lower end communicates with a passage for air coming from a blower; the said hollow shaft extends upward and its upper part is enlarged discharging into a treatment chamber surrounded by a screen within which the hollow shaft supports a screw conveyor and a rotor for impelling the grain; the latter is thrown against the screen and its movement is broken by vertical knife intensifiers of the work situated on the sides of the chamber; and an extractor disposed above the treatment chamber to discharge the grain elevated from the lower portion toward a lateral outlet in the upper right-hand of the machine.

2. A whitening, polishing or pearling machine for grains and cereals and more particularly for rice as specified in claim 1, further characterized in that the flour dust produced during the treatment passes through the screen and descends by gravity through the lateral spaces of the chamber toward a lower outlet in which it is collected.

3. A whitening, polishing or pearling machine for grains and cereals and more particularly for rice, as specified in claim 1, further characterized in that the current of air from the blower is regulated by means of a movable valve which allows or impedes a greater or lesser flow of air to the treatment chamber.

4. A whitening, polishing or pearling machine for grains and cereals and more particularly for rice, as claimed in claim 1, further characterized by a plurality of orifices made in the shaft of the rotor for expelling the air produced by the blower and which airflow penetrates into the treatment chamber by means of the lower hollow shaft.

5. A whitening, polishing or pearling machine for grains and cereals and more particularly for rice, as claimed in claim 1, characterized in that the screen comprises a drum adjustably carrying said knife intensifiers, whereon the grains are scraped and polished, and the intensity of which polish is determined by the distance of separation between the knives and the rotor.

6. A whitening, polishing or pearling machine for grains and cereals and more particularly for rice, as claimed in claim 1, further characterized in that for several steps during the polishing process the machines are installed in sequence and joined together directly on a single level.

7. A whitening, polishing or pearling machine for grains and cereals and more particularly for rice, as claimed in claim 1, further characterized by a deflecting plate in the lateral outlet, to regulate the movement of the product to the outside.

8. A whitening, polishing or pearling machine for grains and cereals and more particularly for rice, as claimed in claim 1, further characterized in that for several steps during the polishing process the machines are installed in sequence and joined together by regulating hoppers placed at the outlet of the machines in order to be connected together always on a single level.

* * * * *